US009114922B2

(12) United States Patent
Kageyama et al.

(10) Patent No.: US 9,114,922 B2
(45) Date of Patent: Aug. 25, 2015

(54) KNOCK-TYPE PROPELLING CONTAINER

(75) Inventors: Hidehei Kageyama, Saitama (JP); Yoshio Noguchi, Saitama (JP); Tomoaki Suzuki, Saitama (JP)

(73) Assignee: KOTOBUKI & CO., LTD., Kawagoe-Shi, Saitama (JP)

( * ) Notice: Subject to any disclaimer, the term of this patent is extended or adjusted under 35 U.S.C. 154(b) by 0 days.

(21) Appl. No.: 13/816,207

(22) PCT Filed: Aug. 10, 2011

(86) PCT No.: PCT/JP2011/068299

§ 371 (c)(1),
(2), (4) Date: Feb. 8, 2013

(87) PCT Pub. No.: WO2012/020803

PCT Pub. Date: Feb. 16, 2012

(65) Prior Publication Data

US 2013/0134189 A1 May 30, 2013

(30) Foreign Application Priority Data

Aug. 11, 2010 (JP) ..... 2010-180293

(51) Int. Cl.
*B43K 21/18* (2006.01)
*B65D 83/00* (2006.01)
(Continued)

(52) U.S. Cl.
CPC ..... *B65D 83/005* (2013.01); *A45D 34/00* (2013.01); *A45D 40/20* (2013.01); *A45D 40/205* (2013.01);
(Continued)

(58) Field of Classification Search
USPC ..... 604/209; 222/94, 105, 137, 386, 391; 401/66, 82, 84, 109, 111–114, 163, 401/165–167, 169, 171, 176, 179–182, 401/DIG. 1
See application file for complete search history.

(56) References Cited

U.S. PATENT DOCUMENTS 2,541,949 A * 2/1951 Thacker et al. ..... 401/179
4,444,560 A * 4/1984 Jacklich ..... 604/224
(Continued)

FOREIGN PATENT DOCUMENTS

CN 1650773 A 8/2005
EP 2269483 A1 1/2011
(Continued)

OTHER PUBLICATIONS

International Search Report in PCT/JP2011/068299 dated Sep. 6, 2011 (English Translation Thereof).
(Continued)

*Primary Examiner* — Paul R Durand
*Assistant Examiner* — Andrew P Bainbridge
(74) *Attorney, Agent, or Firm* — McGinn IP Law Group, PLLC

(57) ABSTRACT

A knock-type propelling includes a body storing a medium therein and having a tip end opening for allowing the medium to be propelled therefrom, a propelling member slidably arranged in the body and capable of propelling the medium toward the opening, the propelling member being provided with a forward/rearward extending prolongation portion having engaging-stop portions formed at fixed intervals in a forward/rearward direction, a knock member provided at the body so as to be reciprocably moved relative to the body, a thrusting member arranged in the body so as to be moved forward by knocking the knock member, and having an engagement portion engageable with the engaging-stop portions, and a detent member fixedly arranged in the body and engageable with the propelling member.

9 Claims, 15 Drawing Sheets

(51) Int. Cl.

| | |
|---|---|
| ***A45D 40/20*** | (2006.01) |
| ***A45D 34/00*** | (2006.01) |
| ***B43K 23/016*** | (2006.01) |
| ***B43K 24/00*** | (2006.01) |
| ***B43L 19/00*** | (2006.01) |

(52) U.S. Cl.

CPC ..... *B43K 23/016* (2013.01); *B43K 24/00* (2013.01); *B43L 19/00* (2013.01); *B43L 19/0018* (2013.01); *B43L 19/0068* (2013.01)

(56) References Cited

U.S. PATENT DOCUMENTS

| | | | | |
|---|---|---|---|---|
| 4,659,327 | A * | 4/1987 | Bennett et al. | 604/135 |
| 5,011,317 | A * | 4/1991 | Gueret | 401/66 |
| 5,927,882 | A | 7/1999 | Kageyama | |
| 5,961,236 | A | 10/1999 | Kageyama | |
| 6,729,785 | B2 * | 5/2004 | Wijerama | 401/17 |
| 6,874,657 | B2 * | 4/2005 | Metzner et al. | 222/82 |
| 7,452,147 | B2 * | 11/2008 | Rolion et al. | 401/65 |
| 7,749,200 | B2 * | 7/2010 | Graf et al. | 604/187 |
| 8,528,785 | B2 * | 9/2013 | Naughton | 222/137 |
| 8,540,124 | B2 * | 9/2013 | Francavilla | 222/391 |
| 2005/0169695 | A1 | 8/2005 | Noguchi | |
| 2009/0095777 | A1 * | 4/2009 | Francavilla | 222/391 |
| 2009/0314808 | A1 * | 12/2009 | Pires et al. | 222/391 |
| 2011/0020048 | A1 | 1/2011 | Fukumoto | |
| 2014/0021225 | A1 * | 1/2014 | Francavilla | 222/391 |

FOREIGN PATENT DOCUMENTS

| | | | |
|---|---|---|---|
| JP | 52-022778 | | 2/1977 |
| JP | 60-086484 | | 6/1985 |
| JP | 64-008317 | | 1/1989 |
| JP | 09-202095 | A | 8/1997 |
| JP | 2005-212418 | A | 8/2005 |
| JP | 2005-246871 | A | 9/2005 |
| JP | 2009-261725 | A | 11/2009 |
| JP | 2010-088794 | A | 4/2010 |

OTHER PUBLICATIONS

Chinese Office Action dated Nov. 15, 2014 with English Translation.

* cited by examiner

Fig.1
Fig.1A
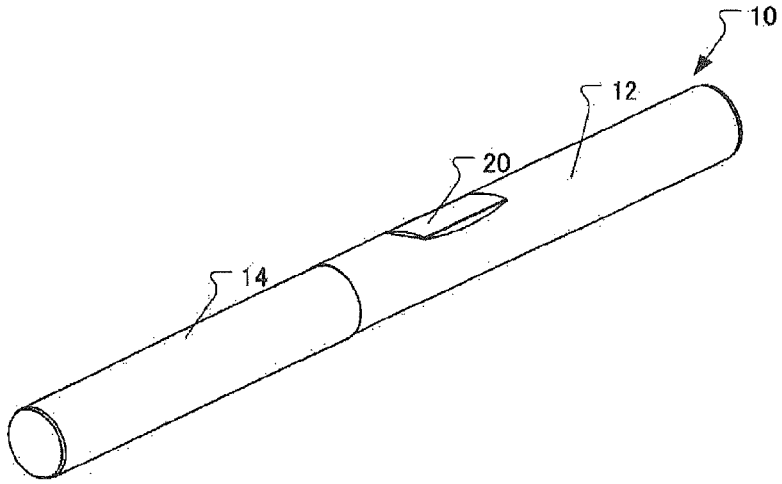
Fig.1B
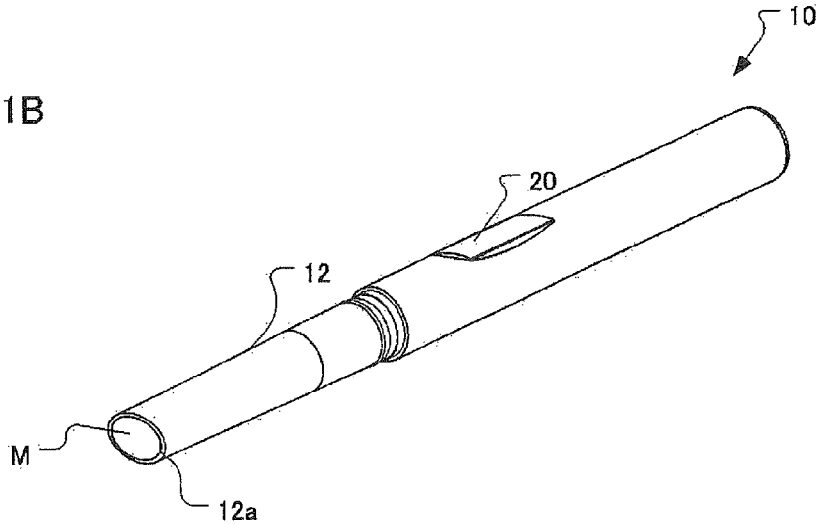

Fig.5
Fig.5A
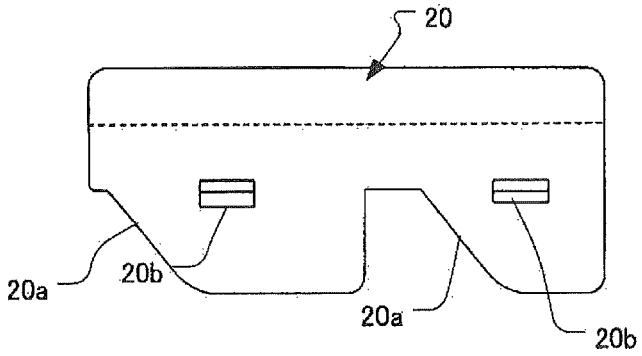
Fig.5B
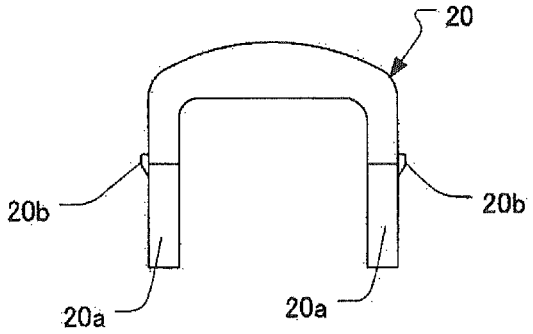

Fig. 8
Fig. 8A
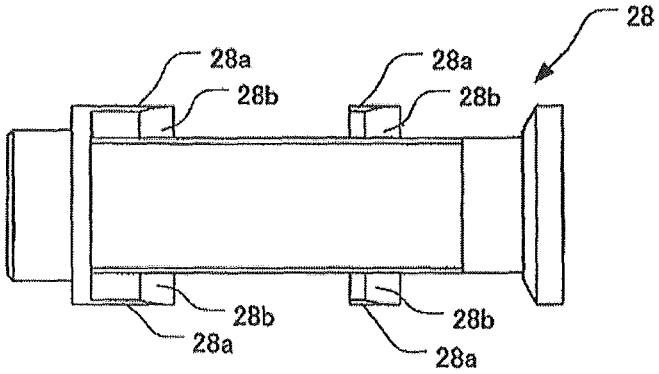
Fig. 8B
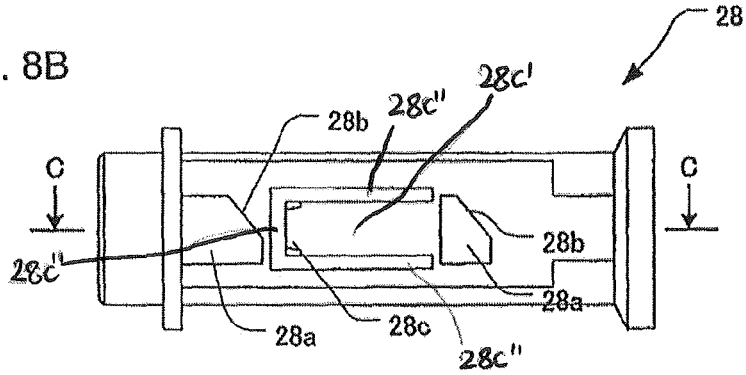
Fig. 8C
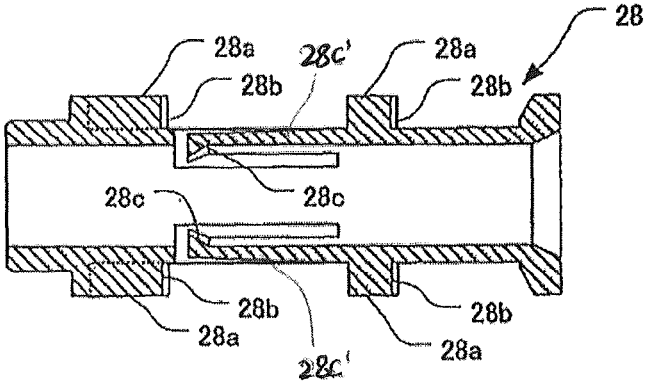

Fig.9
Fig.9A
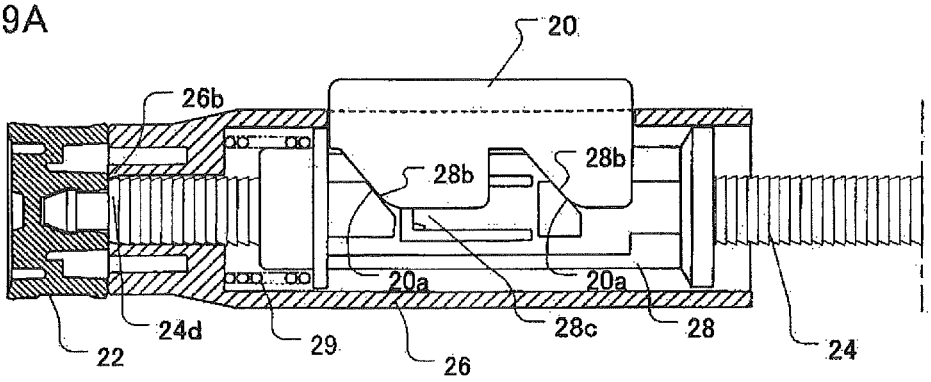
Fig.9B
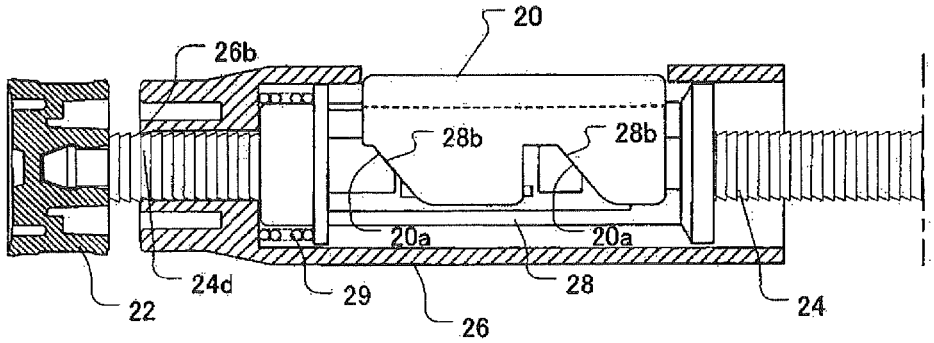
Fig.9C
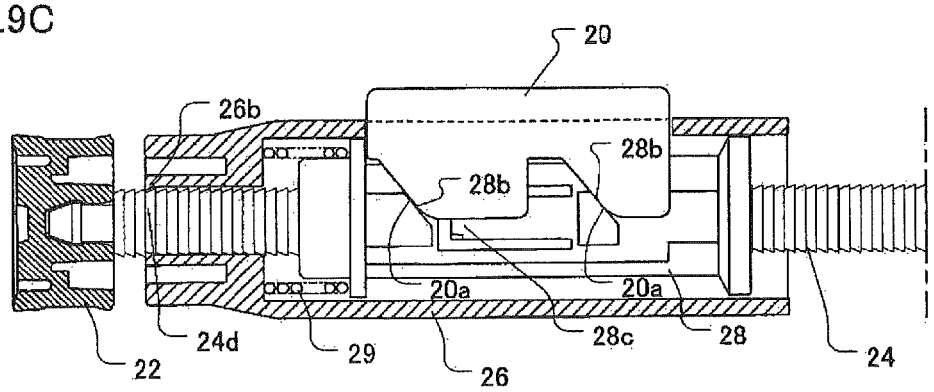

Fig.10
Fig.10A
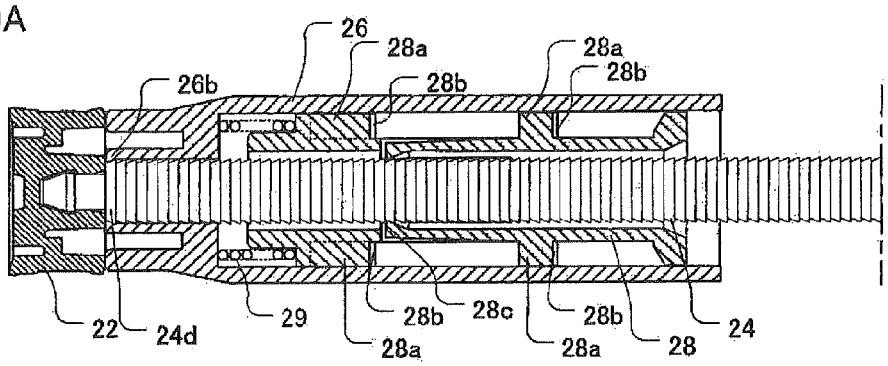
Fig.10B
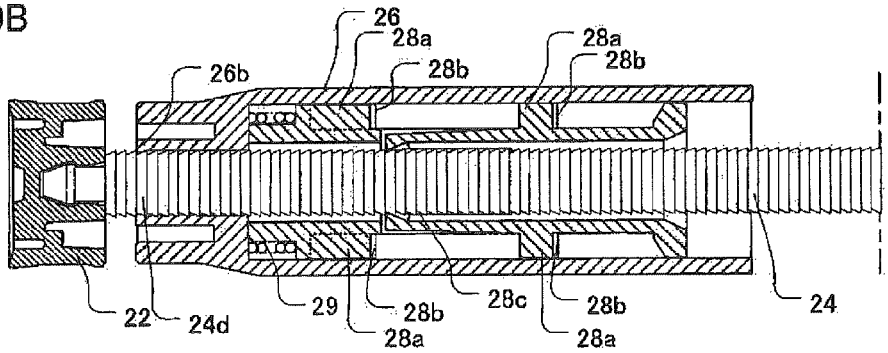
Fig.10C
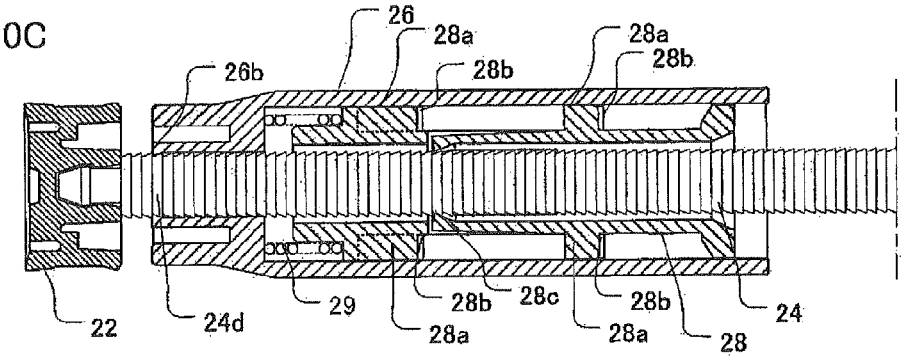

Fig.14
Fig.14A
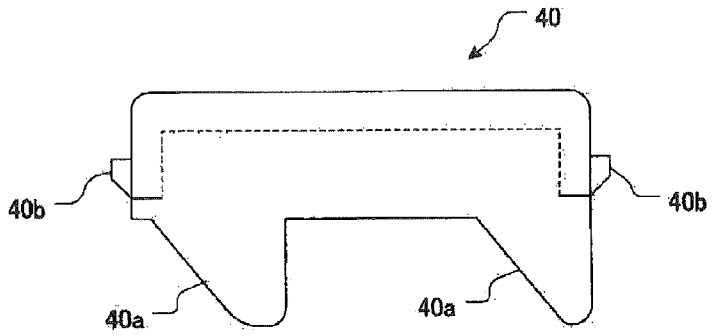
Fig.14B
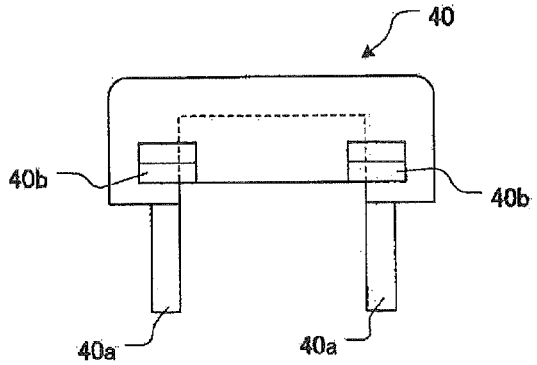

Fig. 16
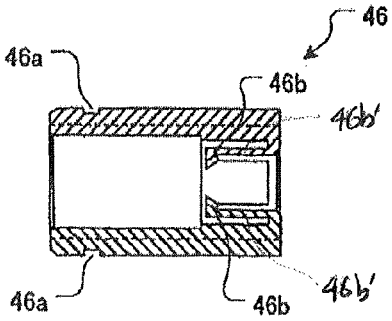
Fig. 17
Fig. 17A
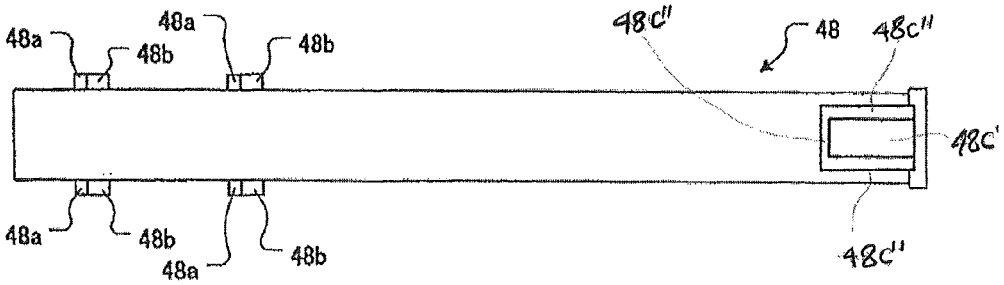
Fig. 17B
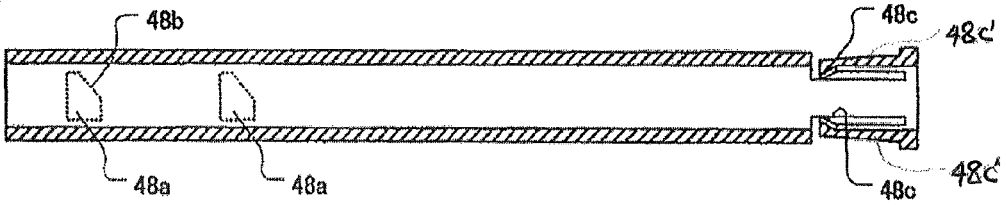

KNOCK-TYPE PROPELLING CONTAINER

TECHNICAL FIELD

The present invention relates to a knock-type propelling container which is adapted to propel, by knocking a knock member of the knock-type propelling container, media which are used in the fields of cosmetics, writing, correcting, medical treatment (dental surgery), industry, etc.

BACKGROUND ART

As a knock-type propelling container of this kind, there has been known a knock-type propelling container which is disclosed in Patent Literature 1. The knock-type propelling container disclosed in the Patent Literature 1 comprises a body having a tank portion built therein for storing liquid and a tip end opening from which the liquid is adapted to be propelled, a knock member provided at a side portion of the body so as to be insertable into and out of the body, a rotation member housed in the body and adapted to be rotated in a predetermined direction by knocking the knock member and rotated in an opposite direction when the knock member is released from the knocking operation, a rotation control mechanism housed in the body for controlling the rotational direction of the rotation member, a propelling member housed in the body for propelling the liquid, and a screw conversion mechanism housed in the body for converting the rotational movement of the rotation member into forward movement of the propelling member in an axial direction of the body.

In the above-mentioned conventional knock-type propelling container, when the knock member is knocked, the rotation member is rotated, the rotational movement of the rotation member is converted into the forward movement of the propelling member by the screw conversion mechanism, and the liquid is adapted to be propelled out of the body in an amount corresponding to a forward moving amount of the propelling member that depends upon a rotation angle of the rotation member.

PRIOR ART LITERATURE

Patent Literature

Patent Literature 1: Japanese Patent Application Laid-Open Publication No. 2005-212418

SUMMARY OF THE INVENTION

Problem to be Solved by the Invention

However, in the above-mentioned conventional knock-type propelling container, the rotational movement of the rotation member is converted into the forward movement of the propelling member by the screw conversion mechanism, so that an issue has been raised that the knock-type propelling container is forced to be made complicated in order to cause the amount of the liquid (medium) propelled out of the body to be limited to a quantitative amount.

The present invention has been made with a view of the aforesaid background and it is an object of the present invention to provide a knock-type propelling container having a simpler structure which allows a medium to be quantitatively propelled out of a body of the knock-type propelling container by knocking a knock member of the knock-type propelling container.

Means for Solving the Problem

In order to attain the above-mentioned object, a knock-type propelling container according to the present invention comprises a body storing a medium therein and having a tip end opening for allowing the medium to be propelled therefrom, a propelling member arranged in the body so as to be slid in a forward/rearward direction of the body and capable of propelling the medium toward the tip end opening, the propelling member being provided with a forward/rearward extending prolongation portion which has a series of engaging-stop portions formed at fixed intervals in the forward/rearward direction, a knock member provided at the body so as to be reciprocably moved with respect to the body, a thrusting member arranged in the body and always biased in a rearward direction, the thrusting member being adapted to be moved forward by knocking the knock member and stoppingly engaged with the engaging-stop portions of the propelling member so as to rearward slippable relative to the engaging-stop portions of the propelling member, and a detent member fixedly arranged in the body in the forward/rearward direction and engaged with the propelling member so as to be rearward slippable relative to the propelling member.

The prolongation portion may comprise a plurality of circular truncated cone-shaped portions continuously formed, each of which constitutes one of the engaging-stop portions.

The thrusting member may be provided with a thrusting pawl that is formed at a tip end of an elastic piece portion deformable in a radial direction relative to the prolongation portion, and is adapted to be stoppingly engaged with the engaging-stop portions.

The detent member may be provided with a detent pawl that is formed at a tip end of an elastic piece portion deformable in the radial direction relative to the prolongation portion, and is stoppingly engaged with the engaging-stop portions.

The knock member may be arranged at a side portion of the body and adapted to be reciprocably moved in a direction perpendicular to the forward/rearward direction of the body. The knock member may be formed with a first cam surface. The thrusting member may be formed with a second cam surface slidable relative to the first cam surface. When the knock member is knocked, the first cam surface and the second cam surface are cooperated with each other, to thereby allow the thrusting member to be moved forward.

The body may have a plurality of tip end openings. The propelling member may have a plurality of pistons provided correspondingly to the plurality of tip end openings and thrusting the medium to the tip end openings. The prolongation portion may be arranged in parallel to the plurality of pistons.

Advantageous Effects of the Invention

According to the present invention, by knocking the knock member, the thrusting member is moved forward. The thrusting member is stoppingly engaged with the engaging-stop portions of the propelling member, so that the propelling member is moved forward according to the forward movement of the thrusting member, to thereby propel the medium. When the knock member is released from the knocking operation, the thrusting member is moved rearward by a biasing force that is applied to the thrusting member to bias the thrusting member in the rearward direction. At this time, the propelling member cannot be moved rearward since the propelling member is stoppingly engaged by the detent member, and the thrusting member can be returned to its original state while rearward slipping relative to the propelling member.

Thus, each time the knock member is knocked, the propelling member which is engaged by the detent member is moved forward, to thereby enable the medium to be propelled out of the body.

The thrusting member is stoppingly engaged with the series of engaging-stop portions formed at the fixed intervals on the prolongation portion of the propelling member, so that quantitative propelling of the medium can be carried out with a simple structure.

BRIEF DESCRIPTION OF THE DRAWINGS

[FIG. 1] FIG. 1 is an entire perspective view which shows a knock-type propelling container according to a first embodiment of the present invention.

FIG. 2 is an entire sectional view which shows the knock-type propelling container according to the first embodiment of the present invention.

FIG. 3 is an entire sectional view illustrating a state where a knock member of the knock-type propelling container shown in FIG. 1 is knocked.

FIG. 4 is an exploded perspective view of an essential part of the knock-type propelling container shown in FIG. 1.

[FIG. 5] FIG. 5A is a side view of the knock member and FIG. 5B is a front view of the knock member.

FIG. 6 is a side view of a piston and piston rod of the knock-type propelling container shown in FIG. 1.

FIG. 7 is a sectional view which illustrates a detent cylinder of the knock-type propelling container shown in FIG. 1.

[FIG. 8] FIG. 8A is a top plane view which illustrates a thrusting cylinder of the knock-type propelling container shown in FIG. 1, FIG. 8B is a side view of the thrusting cylinder, and FIG. 8C is a sectional view of the thrusting cylinder, taken along a line C-C in FIG. 8B.

[FIG. 9] FIG. 9 is a sectional view showing the operation of the knock-type propelling container shown in FIG. 1, wherein FIG. 9A, FIG. 9B, and FIG. 9C are a sectional view of the essential part before the knock member is knocked, a sectional view of the essential part during the knock member is knocked, and a sectional view of the essential part after the knocking operation is finished, respectively.

[FIG. 10] FIG. 10 is a sectional view showing the operation of the knock-type propelling container of FIG. 1 at a position different by an angle of 90 degrees from a position shown in FIG. 9, wherein FIG. 10A, FIG. 10B, and FIG. 10C are a sectional view of the essential part before the knock member is knocked, a sectional view of the essential part during the knock member is knocked, and a sectional view of the essential part after the knocking operation is finished, respectively.

FIG. 11 is an entire top plane view which shows a knock-type propelling container according to a second embodiment of the present invention.

FIG. 12 is an entire sectional view of the knock-type propelling container shown in FIG. 11.

FIG. 13 is a sectional view of the knock-type propelling container of FIG. 11, taken on a surface thereof different by an angle of 90 degrees from a surface of the knock-type propelling container which is taken in FIG. 12.

[FIG. 14] FIG. 14A is a side view of a knock member of the second embodiment and FIG. 14B is a front view of the knock member of the second embodiment.

[FIG. 16] FIG. 16 is a sectional view of a detent cylinder of the knock-type propelling container shown in FIG. 11.

[FIG. 17] FIG. 17A is a top plane view of a thrusting cylinder of the knock-type propelling container shown in FIG. 11, and FIG. 17B is a sectional view of the thrusting cylinder of the knock-type propelling container shown in FIG. 11.

MODES FOR CARRYING OUT THE INVENTION

Embodiments according to the present invention will be discussed hereinafter with reference to the accompanying drawings.

Figure 2:
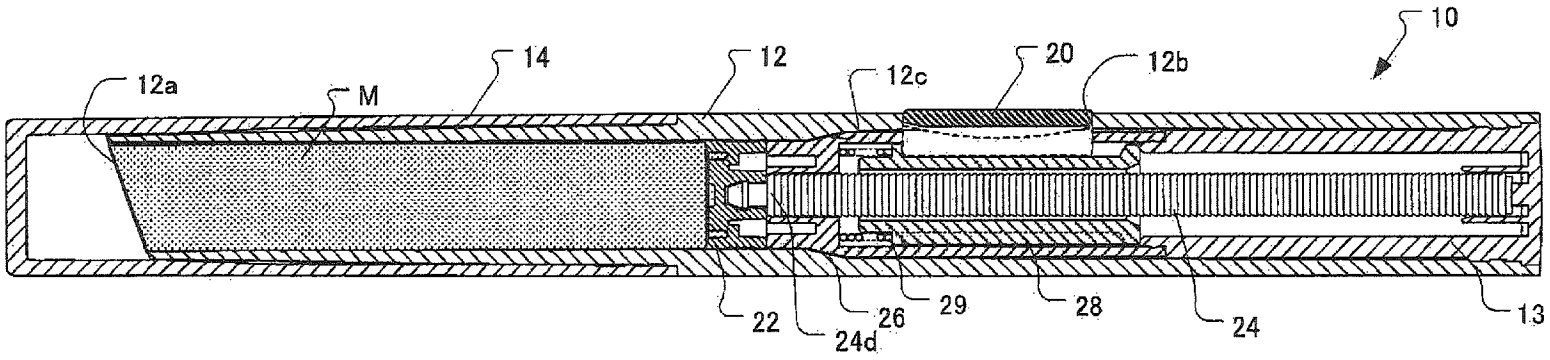
[FIG. 2]
Figure 3:
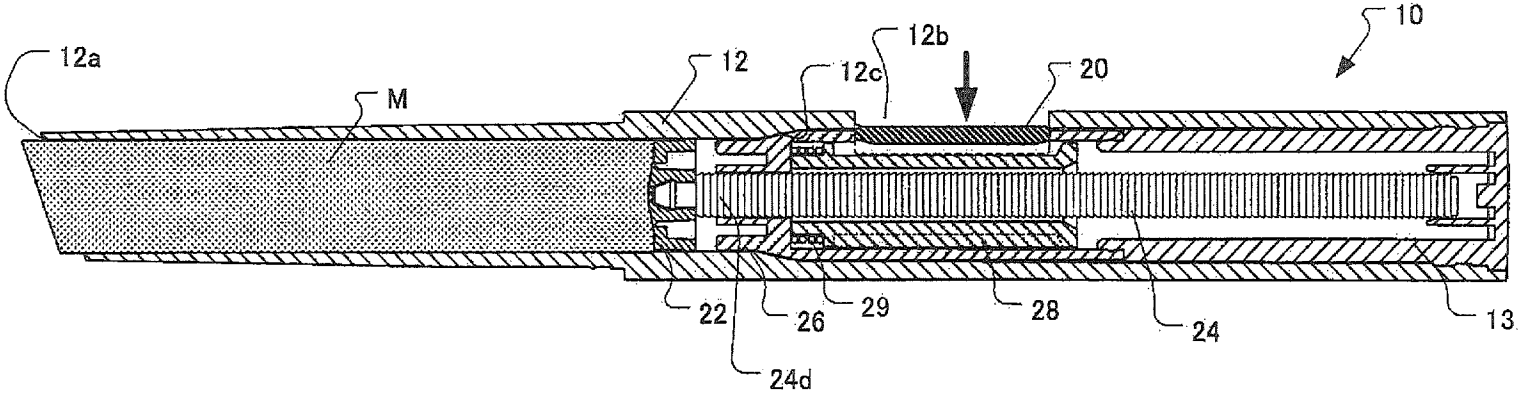
[FIG. 3]
Figure 4:
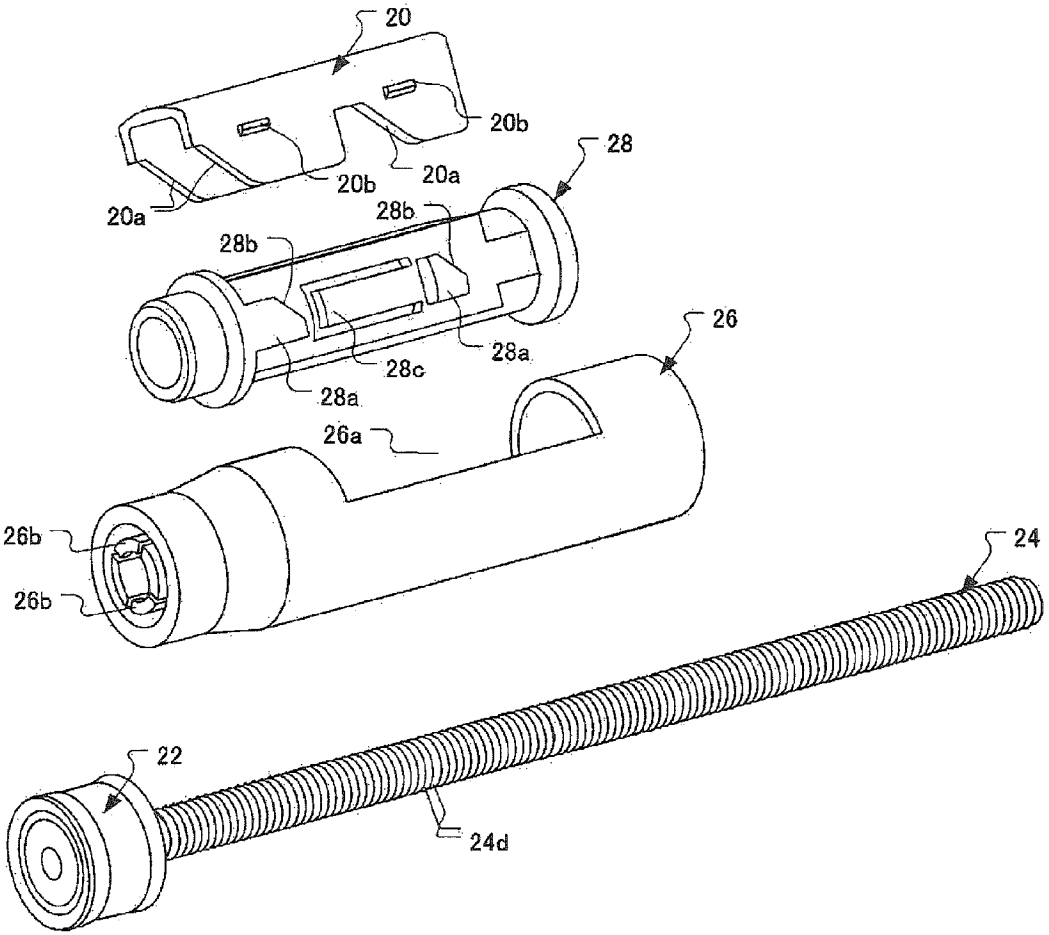
[FIG. 4]

Referring to FIGS. 1-4, there is illustrated a knock-type propelling container according to a first embodiment of the present invention. In FIGS. 1-3, a reference sign 10 denotes the knock-type propelling container. The knock-type propelling container 10 includes a longitudinal body 12 to be held by a user, and a cap 14 detachably mounted with respect to the body 12.

A medium M which is an object to be propelled by the knock-type propelling container 10 is stored in an interior of the body 12. As the medium M, there may be employed any medium in a voluntary form such as solid, liquid, or gel. While a cosmetic medium for an eyeliner, for example, is employed in this embodiment, the medium which is to be propelled by this embodiment is not limited to such a medium and, as the medium to be propelled by this embodiment, there may be employed media which are used in the fields of writing, correcting, medical treatment (including dental surgery), and industry. The medium M is adapted to be capable of being propelled from a tip end opening 12*a* which is formed in a tip end of the body 12. Incidentally, the body 12 may be assembled from several parts. During nonuse of the knock-type propelling container 10, the cap 14 is mounted on the body 12 so as to cover the tip end opening 12*a*.

The body 12 has a lateral opening 12*b* formed in a side surface thereof. In the lateral opening 12*b*, a knock member 20 to be operated by the user is provided. The knock member 20 is adapted to be reciprocatably moved between inward and outward positions relative to the body 12 in a direction perpendicular to a forward/rearward direction of the body 12.

The knock member 20 is formed substantially into a U-shape in cross-section. As shown in FIG. 5, both side portions of the knock member 20 are notched in lower ends thereof, to thereby form plural cam surfaces 20*a*. Moreover, outer surfaces of the both side portions of the knock member 20 are provided with ribs 20*b* for preventing the knock member 20 from coming out of the lateral opening 12*b* of the body 12.

A piston 22 and a piston rod 24 are provided in the body 12 so as be slidable in a forward/rearward direction. The piston 22 is adapted to be capable of thrusting the medium M toward the tip end opening 12*a*. The piston rod 24 is connected to a rear end of the piston 22 and extends in the forward/rearward direction. The piston 22 and the piston rod 24 form a propelling member. The piston rod 24 constitutes a forward/rearward extending prolongation portion of the propelling member.

Figure 6:
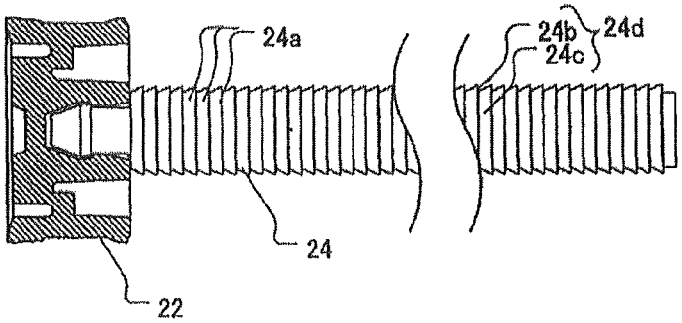
[FIG. 6]

As shown in FIG. 6, the piston rod 24 has a series of circular truncated cone-shaped portions 24*a* formed on an outer peripheral surface thereof and continued in the forward/rearward direction, in which step portions 24*b* formed by bottom surfaces of the circular truncated cone-shaped portions 24*a*, and taper portions 24*c* formed by slanted surfaces of the circular truncated cone-shaped portions 24*a* are alternately repeated. In the series of circular truncated cone-shaped portions 24*a*, engaging-stop portions 24*d* are each defined by a step portion 24*b* and a taper portion 24*c*between two adjacent circular truncated cone-shaped portions 24*a*. That is, engaging-stop portions 24*d* are formed at fixed intervals in the forward/rearward direction along the prolongation portion of the propelling member.

The knock-type propelling container 10 further includes a double cylinder structure provided in the body 12 for converting radially inward movement of the knock member 20 relative to the body 12 (which is effected by knocking the knock member 20) into forward movement of the propelling member comprising the piston 22 and the piston rod 24 and for allowing the propelling member to quantitatively propel the medium according to the forward movement of the propelling member. The double cylinder structure comprises a detent cylinder 26 arranged in the body 12 and a thrusting cylinder 28 arranged in the detent cylinder 26. The piston rod 24 is inserted through the cylinders 26, 28.

Figure 7:
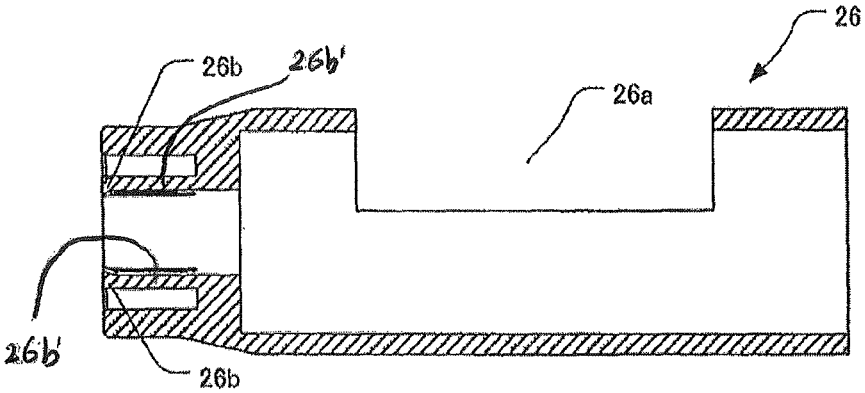
[FIG. 7]

As shown in FIG. 7, the detent cylinder 26 has a notch portion 26*a* formed in a portion thereof which is positionally aligned with the lateral opening 12*b* of the body 12. The detent cylinder 26 further includes a pair of elastic piece portions 26*b*′.each of which is interposed between slits formed by cutting-in the tip end of the detent cylinder 26 and is adapted to be elastically deformable is a radial direction relative to the prolongation portion of the propelling member, and a pair of detent pawls 26 stoppingly engageable with the engaging-stop portions 24*d* of the piston rod 24. Each of the detent pawls 26*b* is formed at a tip end of a corresponding elastic piece portion 26*b*′. The engaging-stop portions 24*d* of the piston rod 24 can be moved forward while slipping relative to the detent pawls 26*b* but cannot slip rearward and is adapted to be maintained in the engagement state with the detent pawls 26*b*. In other words, the detent pawls 26*b* are adapted to be slippable rearward relative to the engaging-stop portions 24*d*.

As shown in FIG. 8, the thrusting cylinder 28 has a plurality of cam protrusions 28*a* provided on an outer peripheral surface thereof so as to be opposed to the cam surfaces 20*a* of the knock member 20. When the knock member 20 is pushed into the body 12 as discussed in detail hereinafter, the cam surfaces 20*a* of the knock member 20 are slidingly contacted with cam surfaces 28*b* if the cam protrusions 28*a*. The thrusting cylinder 28 further includes a pair of elastic piece portions 28*c*′.each of which is surrounded by three slits 28*c*″ formed by cutting-in a peripheral surface of the thrusting cylinder 28 and is adapted to be elastically deformable in the radial direction, and a pair of thrusting pawls 28*c* stoppingly engageable with the engaging-stop portions 24*d* of the piston rod 24. Each of the thrusting pawls 28*c* is formed at a tip end of a corresponding elastic piece portion 28*c*′. As shown in FIGS.8B and 8C, the cam surfaces 28*b* and the elastic piece portions 28*c* ′ are disposed along an axial direction of the thrusting cylinder 28. The thrusting pawls 28*c* can be moved rearward while being slid relative to the engaging-stop portions 24*d* of the piston rod 24 but cannot be slid forward and is adapted to be maintained in the engagement state with the engaging-stop portions 24*d*.

A return spring 29 is arranged between an inner step surface of the detent cylinder 26 and a flange portion of the thrusting cylinder 28 and always biases the detent cylinder 26 and the thrusting cylinder 28 in a direction in which they are spaced away from each other. The detent cylinder 26 is pressedly applied by the return spring 29 onto a taper surface 12*c* formed around an inner surface of the body 12, whereby the detent cylinder 26 is always fixed to the body 12. On the other hand, the thrusting cylinder 28 is always biased in the rearward direction by the return spring 29 and adapted to be movable forward and rearward in the body 12 and the detent cylinder 26.

A rear end of the body 12 is closed by a tail plug 13.

Referring now to FIGS. 9 and 10, the operation of the knock-type propelling container 10 configured as discussed above will be explained hereinafter.

In a case where the knock-type propelling container 10 is used, the cap 14 is first detached from the body 12. When the medium M is intended to be propelled out of the body 12, the knock member 20 is knocked by the user (FIGS. 9A and 10A). When the knock member 20 is pushed into the body 12 by the knocking operation, the cam surfaces 20*a* of the knock member 20 are slidingly contacted with the cam surfaces 28*b* of the thrusting cylinder 28, whereby the knock member 20 thrusts the thrusting cylinder 28 in the forward direction and the thrusting cylinder 28 then causes the return spring 29 to be contracted. The thrusting pawls 28*c* of the thrusting cylinder 28 are engaged with the engaging-stop portions 24*d* of the piston rod 24, so that the piston rod 24 and the piston 22 are moved forward according to the forward movement of the thrusting cylinder 28 (FIGS. 9B and 10B), to thereby propel the medium M from the tip end opening 12*a* of the body 12. When the piston rod 24 is moved forward, the engaging-stop portions 24*d* of the piston rod 24 slip relative to the detent pawls 26*b*, so that the piston rod 24 moves forward relative to the detent cylinder 26.

Next, when the knock member 20 is released from a knocking force that has been applied to the knock member 20 by the knocking operation, the thrusting cylinder 28 tends to be returned in the rearward direction by the biasing force of the return spring 29 and the knock member 20 is thrustedly retuned outward of the body 12. At this time, the engaging-stop portions 24*d* of the piston rod 24 are stoppingly engaged by the detent pawls 26*b* of the detent cylinder 26 and rearward returning movement of the piston rod 24 is prevented. On the other hand, the thrusting pawls 28*c* of the thrusting cylinder 28 slip relative to the engaging-stop portions 24*d* of the piston rod 24, so that the thrusting cylinder 28 is rearward moved relative to the piston rod 24 (FIGS. 9C and 10C).

By one-time knocking operation of the knock member 20, the piston rod 24 is adapted to be moved forward by an amount equivalent to a multiple of repeated pitches of the engaging-stop portions 24*d*which corresponds to an amount of pushing of the knock member 20 into body 12 by the one-time knocking operation of the knock member 20, and the piston rod 24 is then maintained at a position to which the piston rod 24 has been moved according to the one-time knocking operation of the knock member 20, so that it is possible to quantitatively propel the medium M. Moreover, a forward moving amount of the thrusting cylinder 28 movable forward by the one-time knocking operation of the knock member 20 is limited, so that a propelled amount of the medium M which is equivalent to the forward moving amount of the piston rod 24 can be always made equal to or less than a fixed amount.

Moreover, the pushed amount of the knock member 20 may be set to a predetermined extent. In this case, by the one-time knocking operation of the knock member 20, the piston rod 24 can be always moved forward by a moving amount that is equivalent to one pitch or fixed pitches of the engaging-stop portions 24*d*.

Figure 11:
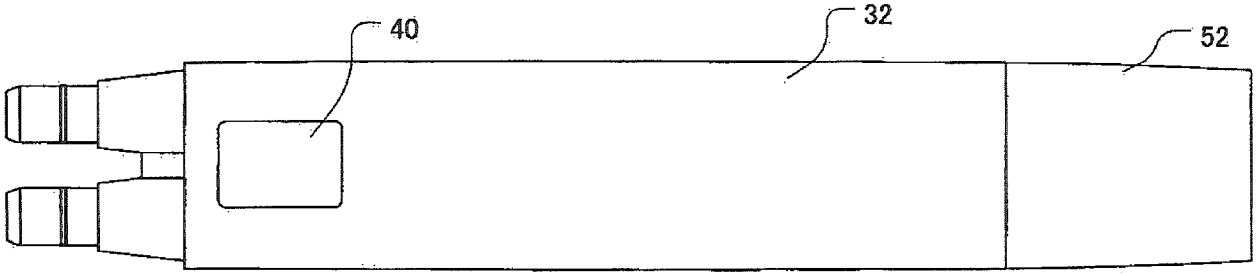
[FIG. 11]
Figure 12:
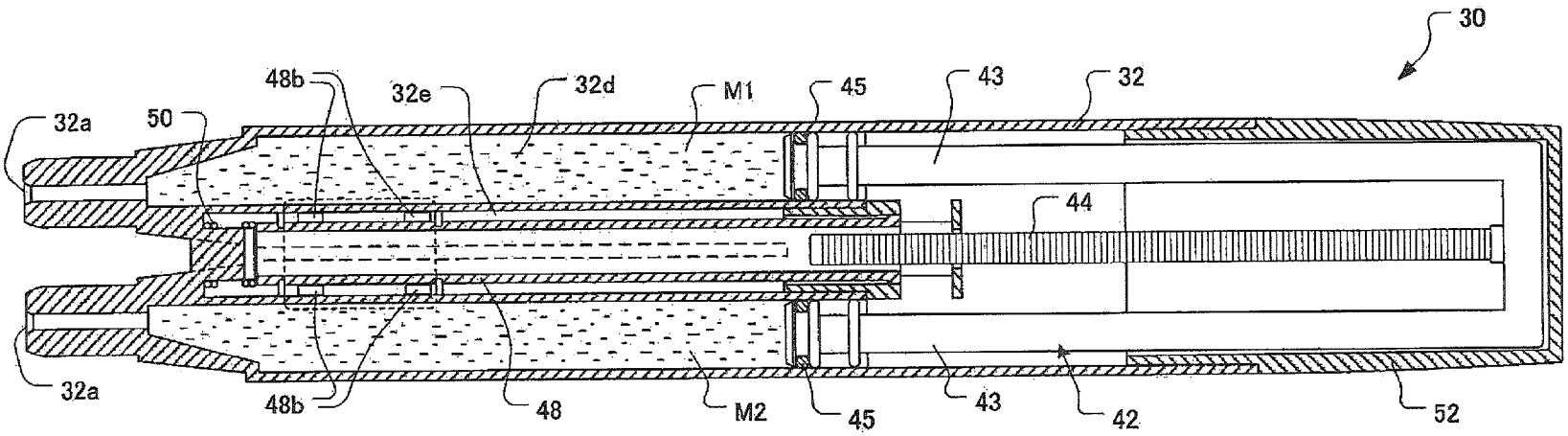
[FIG. 12]
Figure 13:
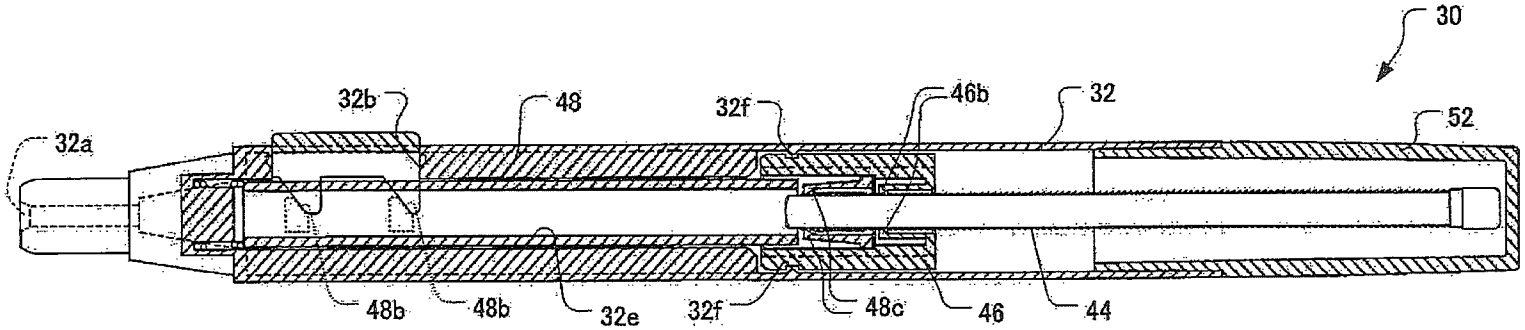
[FIG. 13]

Referring to FIGS. 11-13, there is illustrated a knock-type propelling container according to a second embodiment of the present invention. In FIGS. 12 and 13, a reference sign 30 denotes the knock-type propelling container according to the second embodiment of the present invention. The knock-type propelling container 30 includes a longitudinal body 32 to be held by the user.

Two storage chambers 32*d*, 32*d* are defined in the interior of the body 32. Media M1, M2 that are objects to be propelled by the knock-type propelling container 30 are stored in the storage chambers 32*d*, 32*d*. In this case, one M1 of media different from each other can be stored in one of the storage chambers 32*d*, 32*d* and the other M2 of the media can be stored in the other of the storage chambers 32*d*, 32*d*. The one M1 of the media which is stored in the one of the storage chambers 32*d*, 32*d* can be propelled from a tip end opening 32*a* formed in a tip end of the one of the storage chambers 32*d*, 32*d*, and the other M2 of the media which is stored in the other of the storage chambers 32*d*, 32*d* can be propelled from a tip end opening 32*a* formed in a tip end of the other of the storage chambers 32*d*, 32*d*. The media M1, M2 which are different from each other and propelled out of the container 30 can be mixed with each other outside the container 30. Moreover, a drive chamber 32*e* is defined between the two storage chambers 32*d*, 32*d* in the body 32 so as to be arranged in parallel to the storage chambers 32*d*, 32*d*. Incidentally, the body 32 may be assembled from several parts.

The body 32 has a lateral opening 32*b* formed in a side surface of a tip end portion thereof. A knock member 40 to be knocked by the user is provided in the lateral opening 32*b*. The knock member 40 is adapted to be reciprocatably moved between inward and outward positions relative to the body 32 in a direction perpendicular to a forward/rearward direction of the body 32.

The knock member 40 is formed substantially into a U-shape in cross-section. As shown in FIG. 14, both side portions of the knock member 40 are notched in lower ends thereof, to thereby form plural cam surfaces 40*a*. Moreover, the knock member 40 are provided on outer surfaces of forward and rearward end portions thereof with ribs 40*b* for preventing the knock member 40 from coming out of the lateral opening 32*b* of the body 32.

A forward/rearward slidable propelling-member 42 which can propel the media M1, M2 toward the tip end openings 32*a*, 32*a* is housed in the body 32. The propelling member 42 includes pistons 43 provided correspondingly to the storage chambers 32*d* of the body 32, and a piston rod 44 provided correspondingly to the drive chamber 32*e* of the body 32. Rear end portions of the two pistons 43 are interconnected by a connection portion 43*a*. The piston rod 44 is extended forward from a center of the connection portion 43*a* and constitutes a forward/rearward extending prolongation portion of the propelling member 42.

Figures 15, 15A, 15B:
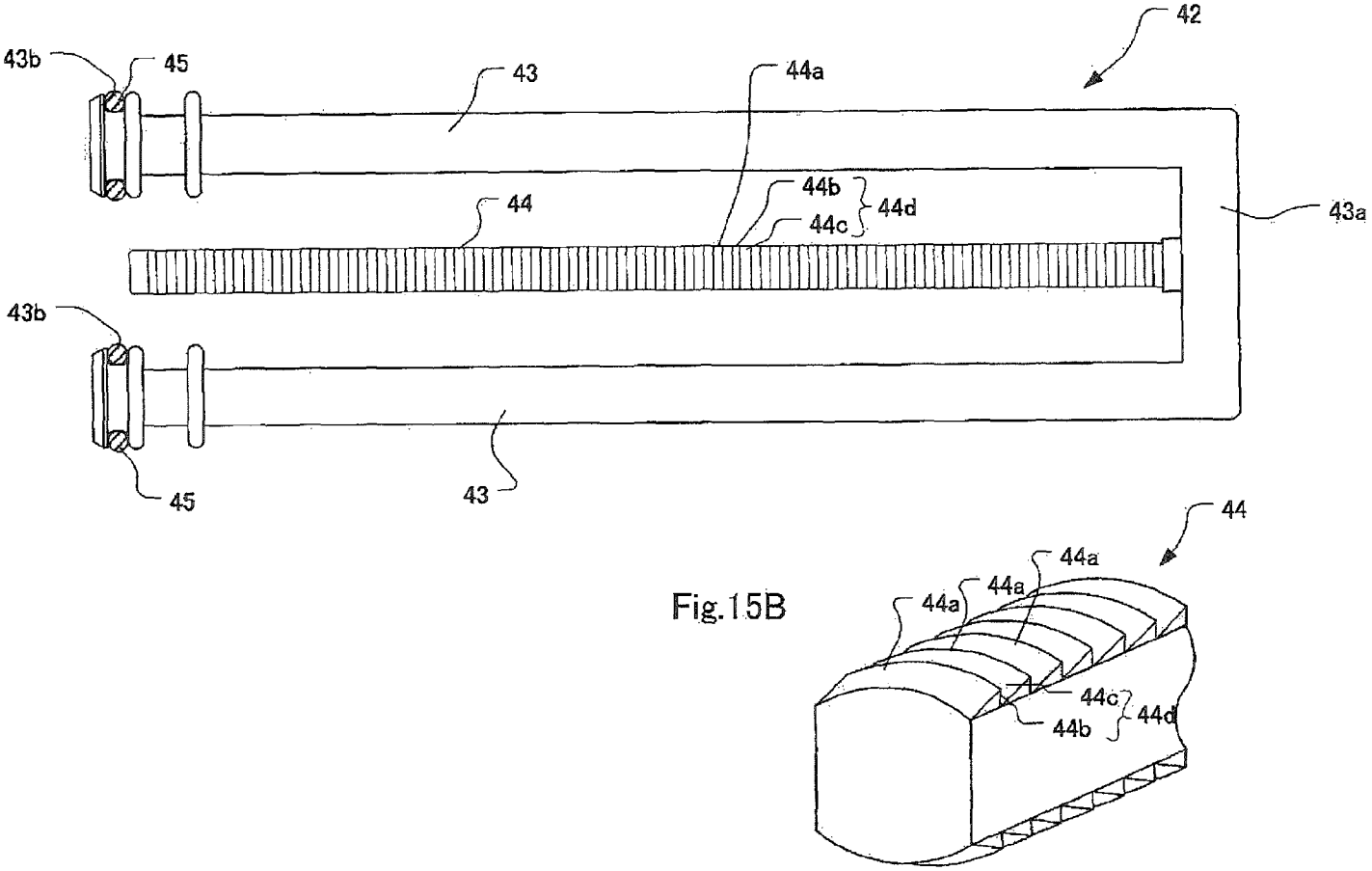
[FIG. 15]
FIG. 15A is a top plane view of a propelling member of the knock-type propelling container shown in FIG. 11.
FIG. 15B is a partial perspective view of a piston rod of the knock-type propelling container shown in FIG. 11.

As shown in FIG. 15, each of the pistons 43 has an annular recess portion 43*b* formed in a tip end portion thereof. An O-ring 45 for sealing is fitted in the annular recess portion 43*b* of the piston 43, so that the piston 43 is adapted to be slidable in the corresponding storage chamber 32*d* while maintaining a sealing property with respect to the storage chamber 32*d*.

Moreover, an outer peripheral surface of the piston rod 44 has a series of circular truncated cone-shaped portions 44*a* continued in the forward/rearward direction, in which step portions 44*b* formed by bottom surfaces of the circular truncated cone-shaped portions 44*a*, and taper portions 44*c* formed by slanted surfaces of the circular truncated cone-shaped portions 44*a* are alternately repeated. In the series of circular truncated cone-shaped portions 44*a*, engaging-stop portions 44*d* are defined by the step portions 44*b* and the taper portion 44*c*between two adjacent circular truncated cone-shaped portions 44*a*.That is, the engaging stop portions 44*d* are formed at fixed intervals in the forward/reward direction along the prolongation portion. The series of circular truncated cone-shaped portions 44*a* is partially cut out. Incidentally, the reason that the series of circular truncated cone-shaped portions 44*a* is partially cut out is that, for example, when positions of respective components of the knock-type propelling container 30 are required to be adjusted at the time of assembling the knock-type propelling container 30, the piston rod 44 can be easily drawn out from a double cylinder structure provided in the body 32 for converting radially inward movement of the knock member 40 relative to the body 32 (which is effected by knocking the knock member 40) into forward movement of the propelling member 42 and for allowing the propelling member 42. The double cylinder structure comprises a detent cylinder 46 arranged in the body 32, and a thrusting cylinder 48.

Moreover, the detent cylinder 46 and the thrusting cylinder 48 are provided in the drive chamber 32*e* of the body 32. A rear portion of the thrusting cylinder 48 is inserted in the detent cylinder 46. The piston rod 44 is inserted in these cylinders 46, 48.

As shown in FIG. 16, the detent cylinder 46 has grooves 46*a* which engagedly receive protrusions 32*f* (FIG. 13) formed on an inner peripheral surface of the body 32. By engagement between the grooves 46*a* and the protrusions 32*f*, the detent cylinder 46 is fixedly arranged in the body 32 in the forward/rearward direction. The detent cylinder further includes a pair of elastic piece portions 46*b*′, each of which extends to the interior of the detent cylinder 46 from a rear end of the detent cylinder 46 and is adapted to be elastically deformable in the radial direction. and a pair of detent pawls 46*b*, each of which is formed at a tip end of a corresponding elastic piece portion 46*b*′and stoppingly engaging-stop portions 44*d* of the piston rod 44. The engaging-stop portions 44*d* of the piston rod 44 can be moved forward while slipping relative to the detent pawls 46*b* of the detent cylinder 46 but cannot slip rearward and is adapted to be maintained in the engagement state with the detent pawls 46*b*. In other words, the detent pawls 46*b* are adapted to be rearward slippable relative to the engaging-stop portions 44*d* of the piston rod 44.

As shown in FIG. 17, the thrusting cylinder 48 has plural cam protrusions 48*a* formed on an outer peripheral surface thereof. Cam surfaces 48*b* of the cam protrusions 48*a* are opposed to the cam surfaces 40*a* of the knock member 40. When the knock member 40 is pushed into the body 32 as discussed in detail hereinafter, the cam surfaces 40*a* of the knock member 40 are slidingly contacted with the cam surfaces 48*b* of the thrusting cylinder 48. The thrusting cylinder 48 further includes a pair of elastic piece portions 48*c*′, each of which is surrounded by three slits 48*c* ″ formed by cutting-in a peripheral surface of a rear end portion of the thrusting cylinder 48 and is adapted to be elastically deformable in the radial direction, and a pair of thrusting pawls 48*c*, each of which is formed at a tip end of a corresponding elastic piece portion 48*c*′. As shown in FIG. 17, the cam surfaces 48*b* and the elastic piece portions 48*c*′are disposed along an axial direction of the thrusting cylinder 48. The thrusting pawls 48*c* can be moved rearward while slipping relative to the engaging-stop portions 44*d* of the piston rod 44 but cannot slip forward and is adapted to be maintained in the engagement state with the engaging-stop portions 44*d* of the piston rod 44.

A return spring 50 is provided between a tip end of the thrusting cylinder 48 and a tip end surface of the drive chamber 32*e*. The thrusting cylinder 48 is always biased rearward by the return spring 50 and is adapted to be movable forward and rearward in the drive chamber 32*e*.

A rear end of the body 32 is closed by a tail plug 52.

The knock-type propelling container 30 constructed as discussed above can be operated in the same manner as the knock-type propelling container 10 according to the first embodiment of the present invention is done. Namely, in a case where the media M1, M2 are intended to be propelled out of the body 32, when the knock member 40 is knocked by the user, the knock member 40 is pushed into the body 32 and the cam surfaces 40*a* of the knock member 40 are slidingly contacted with the cam surfaces 48*b* of the thrusting cylinder 48, whereby the knock member 40 causes the thrusting cylinder 48 to be thrust forward and the thrusting cylinder 48 then causes the return spring 50 to be contracted. The thrusting pawls 48*c* of the thrusting cylinder 48 are engaged with the engaging-stop portions 44*d* of the piston rod 44, so that the piston rod 44 and the pistons 43 are moved forward according to the forward movement of the thrusting cylinder 48, to thereby propel the media M1, M2 from the tip end openings 32*a* of the body 32. When the piston rod 44 is moved forward, the engaging-stop portions 44*d* of the piston rod 44 slip relative to the detent pawls 46*b* of the detent cylinder 46, so that the piston rod 44 is forward moved relative to the detent cylinder 46.

When the knock member 40 is released from a knocking force that has been applied to the knock member 40 by the knocking operation, the thrusting cylinder 48 tends to be returned in the rearward direction by the biasing force of the return spring 50 and the knock member 40 is thrustedly retuned outward of the body 32. At this time, the engaging-stop portions 44*d* of the piston rod 44 are stoppingly engaged by the detent pawls 46*b* of the detent cylinder 46 and the rearward returning movement of the piston rod 44 and pistons 43 is prevented. On the other hand, the thrusting pawls 48*c* of the thrusting cylinder 48 slip relative to the engaging-stop portions 44*d* of the piston rod 44, so that the thrusting cylinder 48 is rearward moved relative to the piston rod 44.

By one-time knocking operation of the knock member 40, the piston rod 44 is adapted to be moved forward by an amount equivalent to a multiple of repeated pitches of the engaging-stop portions 44*d*which corresponds to an amount of pushing of the knock member 40 into the body 32 by the one-time knocking operation of the knock member 40, and the piston rod 44 is then maintained at a position to which the piston rod 44 has been advanced, so that it is possible to quantitatively propel the media M1, M2. Moreover, a forward moving amount of the thrusting cylinder 48 movable forward by the one-time knocking operation of the knock member 40 is limited, so that propelled amounts of the media M1, M2 which are equivalent to the forward moving amount of the piston rod 44 can be always made equal to or less than fixed amounts. Moreover, the pushed amount of the knock member 40 may be limited to a predetermined extent. In this case, by the one-time knocking operation of the knock member 40, the piston rod 44 can be always moved forward by a moving amount that is equivalent to one pitch or fixed pitches of the engaging-stop portions 44*d*. Incidentally, while the two storage chambers 32*d*, 32*d* are formed to have the same sectional areas and the two pistons 43, 43 are formed to have the same sectional areas in the illustrated second embodiment, a ratio of the sectional areas of the storage chambers 32*d*, 32*d* and a ratio of the sectional areas of the pistons 43 may be each set to a ratio other than a ratio of 1:1, whereby supply ratios of the media M1, M2 can be varied.

Incidentally, the knock-type propelling containers 10, 30 according to the first and second embodiments are structured as side knock-type propelling containers in which the knock members 20, 40 are provided in the lateral openings 12*b*, 32*b* of the bodies 12, 32, so that the user can carry out the knocking operation of the knock members 20, 40 without re-holding the bodies 12, 32.

However, knock-type propelling containers 10, 30 to which the present invention may be applied are not limited to such side knock-type propelling containers. The present invention may be applied to so-called rear end knock-type propelling containers. In this case, the knock member is arranged at a rear end of the body and integrally connected to the thrusting cylinder (for example, the knock member and the thrusting cylinder may be structured as a one-piece member comprising the knock member and the thrusting cylinder, or the knock member and the thrusting cylinder which are formed separately from each other may be integrally connected to each other), and the thrusting cylinder is always biased in the rearward direction by the return spring. When the knock member is moved forward by knocking the knock member, the thrusting cylinder is adapted to be moved forward together with the knock member. The components other than the knock member and the thrusting cylinder are adapted to be operated in the same manner as those of the first and second embodiments are done, whereby the medium or the media can be propelled out of the body.

Moreover, while the detention of the piston rods 24, 44 is accomplished by the stopping engagement of the detent pawls 26*b*, 46 of the detent cylinders 26, 46 with the engaging-stop portions 24*d*, 44*d* of the piston rods 24, 44 in the above-mentioned examples, the piston rod detention mechanism which may be employed according to the present invention is not limited to such a piston rod detention mechanism. For example, as detent members for the piston rods, there may be employed rubber packings. In this case, the rubber packings are disposed so as to be contactingly engaged with the piston rods 24, 44 and the detention of the piston rods 24, 44 can be accomplished by frictional forces which are produced between the rubber packings and the piston rods 24, 44. Moreover, by employing any voluntary engagement fashion between the detent members and the piston rods 24, 44 or pistons 22, 43 (for example, engagement by magnetic force), the detention of the piston rods 24, 44 and pistons 22, 43 can be accomplished.

Moreover, while the movement of the knock members 20, 40 into the bodies 12, 32 which is effected by knocking the knock members 20, 40 is converted to the forward movement of the thrusting cylinders 28, 48 by cooperation of the cam surfaces 20*a*, 28*b*, 40*a*, 48*b* in the above-mentioned examples, a movement conversion mechanism which may be employed according to the present invention is not limited to such a movement conversion mechanism and the conversion of the movement of the knock members 20, 40 into the forward movement of the thrusting cylinders 28, 48 may be performed by using linkage mechanisms, gear mechanisms or other voluntary mechanisms.

Moreover, elements which are each assembled from several components in the above-mentioned embodiments may be each composed of a single component, and elements which are each composed of a single component in the above-mentioned embodiments may be each assembled from several components.

DESCRIPTION OF REFERENCE SIGNS

10, 30: Nock-type propelling container
12, 32: Body
12*a*, 32*a*: Tip end opening

20, 40: Knock member
20*a*, 40*a*: Cam surface (First cam surface)
22, 43: Piston (Propelling member)
24, 44: Piston rod (Propelling member, Prolongation portion)
24*a*, 44*a*: Circular truncated cone-shaped portion
24*d*, 44*d*: Engaging-stop portion
26, 46: Detent cylinder (Detent member)
26*b*, 46*b*: Detent pawl
28, 48: Thrusting cylinder (Thrusting member)
28*b*, 48*b*: Cam surface (Second cam surface)
28*c*, 48*c*: Thrusting pawl
42: Propelling member
M, M1, M2: Medium This invention claimed is:

1. A knock-type propelling container, comprising:

a body storing a medium therein and having a tip end opening for allowing the medium to be propelled therefrom and a lateral opening formed in a side surface thereof;

a propelling member arranged in the body so as to be slidable in a forward/rearward direction of the body and capable of propelling the medium toward the tip end opening, the propelling member being provided with a forward/rearward extending prolongation portion which includes a series of engaging-stop portions formed at fixed intervals in the forward/rearward direction;

a knock member provided in the lateral opening of the body so as to be reciprocably moved in a radial direction perpendicular to an axial direction of the body; and a double cyclinder structure for converting radially inward movement of the knock member relative to the body into forward movement of the propelling member and for allowing the propelling member to propel the medium toward the tip end opening of the body, the double cylinder structure comprising a detent cylinder fixedly arranged in the body, and a thrusting cylinder arranged in the detent cylinder and always biased in a rearward direction, the propelling member being inserted through the thrusting cylinder and the detent cylinder, the thrusting cylinder being adapted to be moved forward by knocking the knock member and including first cam surfaces provided on an outer peripheral surface thereof, a first pair of elastic piece portions elastically deformable in a radical direction relative to the prolongation portion of the propelling member, each of the first pair of elastic piece portions being surrounded by slits formed in a peripheral surface of the thrusting cylinder, and a pair of thrusting pawls stoppingly engageable with the engaging-stop portions of the propelling member, each of the pair of thrusting pawls being formed at a tip end of corresponding one of the first pair of elastic piece portions, the first cam surfaces and the first pair of elastic piece portions being disposed along an axial direction of the thrusting cylinder, the knock member being formed with second cam surfaces slidingly contactable with the first cam surfaces of the thrusting cylinder, the thrusting cylinder being adapted to be moved forward by cooperation of the first and second cam surfaces when the second cam surfaces of the knock member slidingly contact the first cam surfaces of the thrusting cylinder by knocking the knock member, the detent cylinder being engageable with the engaging-stop portions of the prolongation portion of the propelling member, the prolongation portion of the propelling member being configured in such a manner that the engaging-stop portions thereof slip forward relative to the detent cylinder but do not slip rearward relative to the detent cylinder and are maintained in an engagement state with the detent cylinder, and the thrusting cylinder being configured in such a manner that the pair of thrusting pawls thereof slips rearward relative to the engaging-stop portions but does not slip forward relative to the engaging-stop portions and is maintained in an engagement state with the engaging-stop portions.

2. The knock-type propelling container according to claim 1, wherein the prolongation portion comprises a plurality of circular truncated cone-shaped portions continuously formed, and each of the engaging-stop portions is defined between two adjacent circular truncated cone-shaped portions of the series of circular truncated cone-shaped portions.

3. The knock-type propelling container according to claim 1, wherein the detent cylinder is provided with a second pair of elastic piece portions deformable in the radial direction relative to the prolongation portion, and a detent pawl formed at a tip end of each of the second pair of elastic piece portions and engageable with the engaging-stop portions.

4. The knock-type propelling container according to claim 1, wherein the body comprises a plurality of storage chambers each of which is configured to store the medium therein and is provided with the tip end opening, and the propelling member comprises a plurality of pistons provided correspondingly to the plurality of storage chambers and capable of thrusting the medium to tip end openings of the plurality of storage chambers.

5. The knock-type propelling container according to claim 4, wherein the propelling member is arranged in the body in such a manner that the prolongation portion thereof is arranged in parallel to the plurality of pistons.

6. The knock-type propelling container according to claim 1, wherein the prolongation portion comprises a plurality of circular truncated cone-shaped portions continuously formed, each of the engaging-stop portions being defined between two adjacent circular truncated cone-shaped portions of the series of circular truncated cone-shaped portions, and the detent cylinder is provided with an elastic piece portion deformable in a radial direction relative to the prolongation portion, and a detent pawls formed at a tip end of the elastic piece portion and engageable with the engaging-stop portions.

7. The knock-type propelling container according to claim 1, wherein the prolongation portion comprises a plurality of circular truncated cone-shaped portions continuously formed, each of the engaging-stop portions is defined between two adjacent circular truncated cone-shaped portions of the circular truncated cone-shaped portions, and the detent cylinder is provided with a second pair of elastic piece portions deformable in the radial direction relative to the prolongation portion, and a detent pawl formed at a tip end of each of the second pair of elastic piece portions and engageable with the engaging-stop portions.

8. The knock-type propelling container according to claim 1, wherein the detent cylinder is provided with a second pair of elastic piece portions deformable in the radial direction relative to the prolongation portion, and a detent pawl formed at a tip end of each of the second pair of elastic piece portions and engageable with the engaging-stop portions, the body has a plurality of storage chambers each of which is configured to store the medium therein and provided with the tip end opening, and the propelling member includes a plurality of pistons provided correspondingly to the plurality of storage chambers and capable of thrusting the medium to tip end openings of the plurality of storage chambers.

9. The knock-type propelling container according to claim 1, wherein the propelling member is configured to move forward according to a forward movement of the thrusting cylinder.

* * * * *